US005403502A

United States Patent [19]

Efner

[11] Patent Number: 5,403,502

[45] Date of Patent: Apr. 4, 1995

[54] LUBRICATING ADDITIVE COMPRISING A MOLYBDENUM (VI) HYDROXYMERCAPTIDE

[75] Inventor: Howard F. Efner, Bartlesville, Okla.

[73] Assignee: Phillips Petroleum Company, Bartlesville, Okla.

[21] Appl. No.: 638,794

[22] Filed: Aug. 8, 1984

[51] Int. Cl.[6] ..... C10M 173/02

[52] U.S. Cl. ..... 252/42.7; 252/46.4; 252/49.3

[58] Field of Search ..... 252/46.3, 49.7, 42.7, 252/46.4, 49.3; 556/57, 99.3

[56] References Cited

U.S. PATENT DOCUMENTS 2,346,155 4/1944 Denison, Jr. et al. ..... 252/46.3
2,795,550 6/1957 Harle et al. ..... 556/57
2,805,997 9/1957 Benoit, Jr. et al. ..... 252/42.7
4,239,633 12/1980 Gutierrez et al. ..... 252/46.3
4,259,254 3/1981 Bridger ..... 252/42.7
4,474,673 10/1984 Hunt et al. ..... 252/46.4
4,692,256 9/1987 Umemura et al. ..... 252/46.4

*Primary Examiner*—Jerry D. Johnson
*Attorney, Agent, or Firm*—Ryan N. Cross

[57] ABSTRACT

A composition which is the reaction product of a mercaptoalcohol and the molybdenum compounds selected from the group consisting of molybdic acids, alkali metal salts of molybdic acids and ammonium salts of molybdic acids. The reaction product is useful in improving the lubricating characteristics of fluids used in metal working operations.

12 Claims, No Drawings

LUBRICATING ADDITIVE COMPRISING A MOLYBDENUM (VI) HYDROXYMERCAPTIDE

This invention relates to a composition which is useful as a lubricating additive for fluids used in metalworking operatings.

In machining operations of metals, such as cutting, drilling, tapping, polishing, grinding, turning, milling and the like, it is customary to flood the tool and the work with a coolant for the purpose of carrying off heat which is produced during the operation. Such coolants are typically water-based or are based on liquid organic compounds.

It is also customary to employ these coolants in combination with various agents having lubricating properties for reducing friction between the tool and the work piece. A number of lubricating additives are known. However, it is always desirable to develop new lubricating additives which have desired properties. It is thus an object of this invention to provide a new lubricating additive for fluids used in metalworking operations.

In accordance with the present invention, there is provided a composition which is the reaction product of a mercaptoalcohol and a molybdenum compound selected from the group consisting of molybdic acids, alkali metal salts of molybdic acids and ammonium salts of molybdic acids. When the reaction product is added to fluids used in metalworking operations, the lubricating characteristics of such fluids are improved.

Other objects and advantages of the invention will be apparent from the foregoing brief description of the invention and the detailed description of the invention which follows as well as the claims.

Any suitable molybdenum compound selected from the group consisting of molybdic acids, alkali metal salts of molybdic acids and ammonium salts of molybdic acids may be used to form the reaction product of the present invention. A preferred molybdic acid is $H_2MoO_4$. Examples of suitable alkali metal salts and suitable ammonium salts are $Na_2MoO_4$, $(NH_4)_2MoO_4$, $(NH_4)_5HMo_6O_{21}.xH_2O$, $(NH_4)_4H_2MO_6O_{21}.5H_2O$; $Na_5HMo_6O_{21}.18H_2O$; $Na_4H_2Mo_6O_{21}.13H_2O$; $Na_3H_3Mo_6O_{21}.7\frac{1}{2}H_2O$; $(NH_4)_6Mo_7O_{24}.4H_2O$; $(NH_4)_4Mo8O_{26}.xH_2O$ and $(NH_4)_3H_7Mo_{12}O_{41}.xH_2O$. Ammonium salts are preferred over alkali metal salts because they react with mercaptoalcohols at higher rates. A preferred molybdenum compound for use in forming the reaction product of the present invention is $(NH_4)_6Mo_7O_{24}.4H_2O$.

Any suitable mercaptoalcohol may be utilized to form the reaction product of the present invention. An example of a suitable mercaptoalcohol is a mercaptoalcohol having the following generic formula:

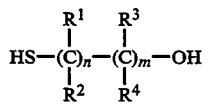

wherein $R^1$, $R^2$, $R^3$ and $R^4$ are independently selected from hydrogen or hydrocarbyl groups (alkyl, cycloalkyl, aryl, alkaryl, cycloalkaryl) having 1–20 (preferably 1–6) carbon atoms, n=1–10 (preferably 1–2), and m=1–10 (preferably 1–2).

Examples of suitable mercaptoalcohols are 2-mercaptoethanol, 1-mercapto-2-propanol, 1-mercapto-2-butanol, 3-mercapto-1-propanol, 1-mercapto-2-hexanol, 2-mercaptocyclohexanol, 2-mercaptocyclopentanol, 3-mercaptobicyclo[2.2.1]-heptane-2-ol, 1-mercapto-2-pentanol, 1-mercapto-2-phenyl-2-ethanol, 3-mercapto-3-phenyl-propane-1-ol, 2-mercapto-3-phenyl-propane-1-ol, thioglycerol 9-mercapto-10-hydroxyoctadecanoic acid, and 10-mercapto-9-hydroxyoctadecanoic acid. Preferred mercaptoalcohols are HS—$CH_2$—$CH_2$—OH (2-mercaptoethanol) and HS—$CH_2$—C($C_6H_5$)H—OH (1-mercapto-2-phenyl-2-ethanol).

The molybdenum compound and the mercaptoalcohol may be combined in any suitable manner and under any suitable reaction conditions. Preferably, the molybdenum compound is first suspended in the mercaptoalcohol or in a mixture of the mercaptoalcohol and any suitable solvent. An example of a suitable solvent is toluene.

The reaction may be carried out at any suitable temperature. The temperature will generally be in the range of about 20° C. to about 250° C. and will more preferably be in the range of about 80° C. to about 120° C.

The reaction may be carried out at any suitable pressure. The pressure will generally be in the range of about 0.1 atmosphere to about 100 atmospheres. A preferred pressure is about 1 atmosphere.

The molybdenum compound and mercaptoalcohol may be reacted for any suitable time. The reaction time will generally be in the range of about 0.1 hour to about 48 hours and will more preferably be in the range of about 0.5 hour to about 3 hours. The completion of the reaction can be observed by a dark red-brown color of the reaction mixture and the disappearance of the suspended molybdenum compound.

Water will form during the reaction. This water may be removed if desired or left in the reaction mixture.

If desired, an excess of the mercaptoalcohol can be used as a diluent in the reaction.

The reaction product will be liquid in form. If a solvent is not used, the reaction product may be used directly as a lubricating additive. However, if a solvent is used, it is desirable to evaporate the solvent prior to use of the reaction product.

The reaction product may be filtered to remove any residual solids or it may be used without filtration.

It is believed that the reaction product is a molybdenum (VI) hydroxymercaptide. However, as will be more fully pointed out in the examples, the exact structure of the reaction product is not known.

The reaction product of the present invention may be utilized to improve the lubricating properties of any suitable fluid used in metalworking operations. Such suitable fluids are generally water-based or based on liquid organic compounds.

Any suitable amount of the reaction product may be added to the metal working fluid. The amount added will generally be such as to result in a concentration of the reaction product in the fluid in the range of about 0.05 weight percent to about 10 weight percent and preferably in the range of about 0.1 weight percent to about 2 weight percent.

The following examples are presented in further illustration of the invention.

EXAMPLE I

In this example, the preparation of an inventive molybdenum (VI) hydroxymercaptide is described.

1-mercapto-2-phenyl-2-ethanol was prepared from 1000 grams of styrene oxide, 567 grams of $H_2S$ and 10 mL of a 20 weight % NaOH solution in methanol. These reactants were pumped into a 1 gallon autoclave reactor and heated from 28° C. to 59° C. during a 1-hour period while the pressure rose from about 350 psig to about 500 psig. At the end of the 1-hour period an additional 20 mL of the NaOH in methanol solution was charged to the autoclave and the reaction mixture was reheated to about 60° C. (at 490 psig) during a 2 hour period. Thereafter, 50 mL of the NaOH/methanol solution was charged to the autoclave and the entire reaction mixture was heated to about 100° C. (at 490 psig) during a period of 50 minutes. Then 50 mL of methanol was added to the autoclave and heating at about 100° C. (400 psig) continued for about 1 hour. 1353 grams of the product, 1-mercapto-2-phenyl-2-ethanol, were recovered.

92.4 grams (0.6 mole) of 1-mercapto-2-phenyl-2-ethanol, 17 grams (0.1 mole Mo) of an ammonium molybdate (approximate chemical formula $(NH_4)_6Mo_7O_{24}.4H_2O$, containing about 85 weight % $MoO_3$; marketed as "molybdic acid" by Mallinckrodt, Inc., St. Louis, Mo.), and 50 mL of toluene were charged to a 300 mL 3-neck flask equipped with magnetic stirrer, Dean-Start trap and reflux condenser. The stirred reaction mixture was heated to 90° C. and kept at this temperature for about 30 minutes. The mixture was then brought to reflux and water was removed as the azeotrope. The formed dark-brown solution was cooled to about 60° C., vacuum-filtered with added filter aid and analyzed. The solution contained about 1.5 weight % Mo (determined by plasma analysis). The main reaction product is believed to be molybdenum (VI) hydroxymercaptide, $Mo(S—CH_2—CHPh—OH)_6$, as judged from the IR spectrum of a related product, prepared from β-mercaptoethanol and ammonium molybdate (see Example II), which showed an OH absorption band but no SH absorption band.

EXAMPLE II

This example illustrates the preparation of another inventive molybdenum (VI) hydroxymercaptide, prepared by reaction of 169 grams (1.0 mole Mo) of ammonium molybdate (same as Example I) and about 468 grams (6 moles) of β-mercaptoethanol (prepared in the Philtex Plant of Phillips Petroleum Company, Phillips, Tex.) in a 1-liter reactor. $N_2$ was sparged through the reaction mixture, while it was heated to about 115° C., so as to remove formed $H_2O$(48 mL distillate was collected). The non-volatilized liquid product was cooled and analyzed by IR spectrometry. It showed a strong OH absorption band but no SH absorption band (2500 $cm^{-1}$). The Mo content was about 17 weight %. It is believed that the formula of the formed product is $Mo(-S—CH_2—CH_2—OH)_6$.

EXAMPLE III

This example illustrates the preparation of a molybdenum hydroxymercaptide without the removal of water. A 1-liter resin flask was charged with 418 mL (468 grams; 6 moles) of crude β-mercaptoethanol. Dissolved $H_2S$ was removed by evacuating the reactor content with stirring. Then 169 grams of 85% "molybdic acid" (containing 1 mole of Mo) were charged. The mixture was heated to 90°–95° C. with stirring for about one hour. The reaction product was cooled and filtered. No noticeable amount of solids was observed on the filter paper.

EXAMPLE IV

The molybdenum (VI) hydroxymercaptide mercaptide prepared in accordance with the procedure of Example II was evaluated for its lubricating and antiwear properties in a modified ASTM D3233 Falex test. The following modifications of the test procedure were made to allow the use of water-based fluids:

1. The oil cup was replaced with a fluid reservoir equipped with an electric heating system. The reservoir was large enough to hold about 500 grams of fluid (the amount used in the test) without having the fluid cover the journal and V-blocks. The fluid was heated to 51° C. before the test was performed.
2. The fluid was circulated from the reservoir via a small circulating pump and directed onto the journal and V-blocks. This prevented localized boiling of the water-based fluid at the journal, and allowed for reproducible testing. The inlet of the circulating pump was protected with a magnet to prevent wear debris from entering the pump.

Two test solutions were prepared:

Solution A: 0.38 g triethanolamine, 3.00 g Polypropylene Glycol 400 (molecular weight: 400; provided by Polysciences, Ltd., Northampton, Great Britain), 494.1 g distilled water, 2.5 g molybdenum (VI) hydroxymercaptide. Solution A contained 0.5 weight % of the molybdenum (VI) hydroxymercaptide.

Solution B: Solution B contained 2.0 weight % of molybdenum (VI) hydroxymercaptide. 0.38 g triethanolamine, 3.00 g Polypropylene Glycol 400, 486.6 g distilled water, 10.0 g molybdenum (VI) hydroxymercaptide.

Both solutions were tested in the above-described Falex testing apparatus at temperatures ranging from about 50° C. to about 65° C. Torques ranged from 23 to 64 inch-lb for Solution A and from 21 to 97 inch-lb for Solution B. No constant wear could be attained and the tests were stopped at Falex fail loads of 2750 lb for Solution A and 2000 lb for Solution B. Both solutions performed considerably better than a control solution (Solution C) containing 0.38 g triethanolamine, 3.0 g Polypropylene Glycol 400 and 496 g distilled $H_2O$ (no Mo-hydroxymercaptide). Solution C failed after only about 5 minutes at a load of only 250 lb. Failure occurred when shear pin and V-blocks either contact-welded or became so rough that the torque was high enough to break the pin.

The above-described test results showed that wear rates for solutions A and B were rather high at high loading while the torques were quite low. This indicates that corrosion wear was possibly occurring. This is desirable in metal working operations where there is cutting such as either drilling or tapping. In these cases, corrosive wear makes it easier for the tool to cut the metal.

Reasonable variations and modifications are possible within the scope of the disclosure and the appended claims to the invention.

That which is claimed is:

1. A method for improving the lubricating properties of a water-based fluid used in metalworking operations comprising the step of adding a molybdenum (VI) hydroxymercaptide to said fluid, wherein said molybdenum (VI) hydroxymercaptide is the reaction product of a mercaptoalcohol and a molybdenum compound selected from the group consisting of molybdic acids, alkali metal salts of molybdic acids and ammonium salts of molybdic acids.

2. A method in accordance with claim 1 wherein said molybdenum compound is an ammonium salt of molybdic acid.

3. A method in accordance with claim 2 wherein said molybdenum compound is $(NH_4)_6Mo_7O_{24}.4H_2O$.

4. A method in accordance with claim 1 wherein said mercaptoalcohol has the generic formula

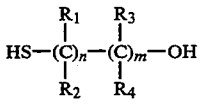

wherein $R_1$, $R_2$, $R_3$ and $R_4$ are independently selected from hydrogen or hydrocarbyl groups (alkyl, cycloalkyl, aryl, alkaryl, cycloalkaryl) having 1–20 carbon atoms, n=1–10 and m=1–10.

5. A method in accordance with claim 1 wherein said mercaptoalcohol has the generic formula

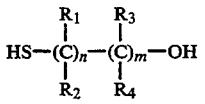

wherein $R_1$, $R_2$, $R_3$ and $R_4$ are independently selected from hydrogen or hydrocarbyl groups (alkyl, cycloalkyl, aryl, alkaryl, cycloalkaryl) having 1–6 carbon atoms, n=1–2 and m=1–2.

6. A method in accordance with claim 5 wherein said mercaptoalcohol is selected from the group consisting of $HS—CH_2—CH_2—OH$ and $HS—CH_2—C(C_6H_5)H—OH$.

7. A method in accordance with claim 1 wherein said molybdenum compound and said mercaptoalcohol are reacted at a temperature in the range of about 20° C. to about 250° C., at a pressure in the range of about 0.1 to about 100 atmospheres and for a reaction time in the range of about 0.1 hour to about 48 hours.

8. A method in accordance with claim 1 wherein said molybdenum compound and said mercaptoalcohol are reacted at a temperature in the range of about 80° C. to about 120° C., at a pressure of about 1 atmosphere and for a reaction time in the range of about 0.5 hour to about 3 hours.

9. A method in accordance with claim 8 wherein said molybdenum compound and said mercaptoalcohol are reacted in the presence of a solvent.

10. A method in accordance with claim 9 wherein said solvent is toluene.

11. A method in accordance with claim 1 wherein the amount of said reaction product added to said fluid is such as to result in a concentration of said reaction product in said fluid in the range of about 0.05 weight-% to about 10 weight-%.

12. A method in accordance with claim 1 wherein the amount of said reaction product added to said fluid is such as to result in a concentration of said reaction product in said fluid in the range of about 0.1 weight-% to about 2 weight-%.

* * * * *